US005664268A

United States Patent [19]

Stoler et al.

[11] Patent Number: 5,664,268

[45] Date of Patent: Sep. 9, 1997

[54] FUTON FRAME

[75] Inventors: Kathleen S. Stoler; Chester L. Stoler, both of Roseville, Minn.

[73] Assignees: Chester Stoler; Kathleen Stoler, both of Roseville, Minn.

[21] Appl. No.: 542,731

[22] Filed: Oct. 13, 1995

[51] Int. Cl.[6] ..... A47C 17/17

[52] U.S. Cl. ..... 5/37.1; 5/47

[58] Field of Search ..... 5/37.1, 41, 47, 5/48

[56] References Cited

U.S. PATENT DOCUMENTS

| | | | |
|---|---|---|---|
| 835,770 | 11/1906 | Williams . | |
| 2,294,475 | 9/1942 | McAllister . | |
| 2,319,337 | 5/1943 | McDaniel . | |
| 2,321,206 | 6/1943 | Holcomb . | |
| 2,324,675 | 7/1943 | Burton . | |
| 2,343,642 | 3/1944 | Burton . | |
| 3,634,893 | 1/1972 | Hern et al. . | |
| 4,642,823 | 2/1987 | Wiggins . | |
| 4,829,611 | 5/1989 | Fireman et al. . | |
| 4,875,244 | 10/1989 | Tremblay . | |
| 4,996,730 | 3/1991 | Fireman et al. . | |
| 5,083,333 | 1/1992 | Newton | 5/37.1 |
| 5,146,640 | 9/1992 | Barton et al. . | |
| 5,153,951 | 10/1992 | Hester | 5/37.1 |
| 5,153,952 | 10/1992 | Barton | 5/37.1 |
| 5,303,432 | 4/1994 | Fitts | 5/37.1 |

*Primary Examiner*—Flemming Saether
*Attorney, Agent, or Firm*—Jacobson & Johnson

[57] ABSTRACT

A multiple use item of furniture which acts as both couch and bed, comprised of two pad support members attached in a pivotal and displaceable fashion wherein the members have limited lateral motion along the pivot point to allow for temporary locking and unlocking of the two pad support members to enable one of the pad support members to be temporarily used as a lever arm to move the other pad support member from a bed position to a back rest position.

11 Claims, 6 Drawing Sheets

FUTON FRAME

FIELD OF THE INVENTION

This invention relates generally to futon frames and, more specifically, to improvements to futon frames enabling quick yet secure conversion of a futon frame from a bed position to a couch position and vice versa.

BACKGROUND OF THE INVENTION

The concept of devices for tilting a sofa bed or futon frame between a bed position and a couch position are old in the art. Typically, they use some type of a pawl or dog which lockingly engages one part of a folding frame with a second part of a folding frame. Generally, these members require gravity to force the pawl or dog into a position which causes latching between the two parts of the folding frame. The present invention eliminates the need for separate pawls or dogs by using pad support members that can be brought into temporary mechanical lever type engagement with one another to move one of the pad support members from the bed position to the couch position.

DESCRIPTION OF THE PRIOR ART

U.S. Pat. No. 5,146,640 shows a latching assembly for a sofa bed which uses pawls to hold the seat and back in position.

U.S. Pat. No. 4,996,730 shows a sofa bed recliner with a mechanism which allows the back member to move forward as a user converts the unit from a couch to a bed.

U.S. Pat. No. 4,829,611 shows a sofa bed recliner with a detent which locks the frames to allow movement from a horizontal to a vertical condition.

U.S. Pat. No. 835,770 shows a convertible couch and bed with pivoting links for movement from a couch position to a seat position.

U.S. Pat. No. 2,343,642 shows a latch and dog arrangement for holding the back in relation to the seat.

U.S. Pat. No. 2,324,675 shows a further embodiment of the latch and dog arrangement of U.S. Pat. No. 2,343,642.

U.S. Pat. No. 4,875,244 shows sofa bed with a triangular block for engaging the back and seat area with each other.

U.S. Pat. No. 3,634,893 illustrates a sofa bed utilizing a pair of reaction plates to adjoin the seat and back areas together.

U.S. Pat. No. 4,642,823 depicts a sofa bed wherein the backrest engages forward upon formation of the bed.

U.S. Pat. No. 2,321,206 shows a sofa bed with seat and back not mechanically connected with one another.

U.S. Pat. No. 2,319,337 depicts a sofa bed wherein the back and seat are connected by permenant fixed bolts.

U.S. Pat. No. 2,294,475 illustrates a sofa bed with back and seat members engaging one another by means of an attached side plate.

SUMMARY OF THE INVENTION

Briefly, the invention comprises a futon which tilts from a bed position to a couch position and vice versa with the futon including a first pad support member and a second pad support member with the second pad support member laterally and pivotally displaceable with respect to the first pad support member to enable the second pad support member to temporarily form a lever arm for engaging the first pad support member to enable the second pad support member to raise the first pad support member from a horizontal position to a generally vertical position to thereby convert the futon from a bed to a couch.

DESCRIPTION OF THE PREFERRED EMBODIMENT

Figure 1:
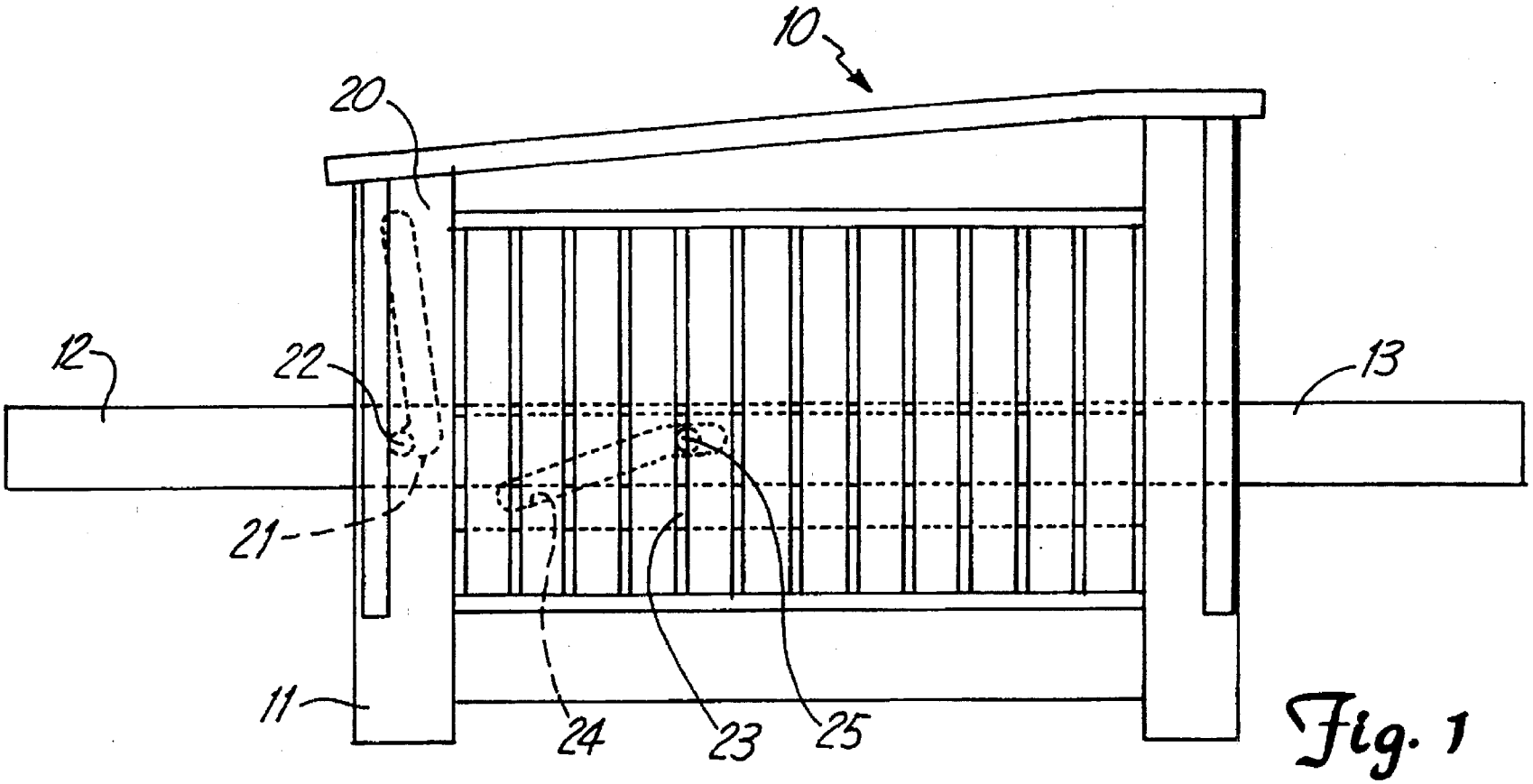
FIG. 1 shows a side view of the futon of the present invention in the bed position.
Figure 11:
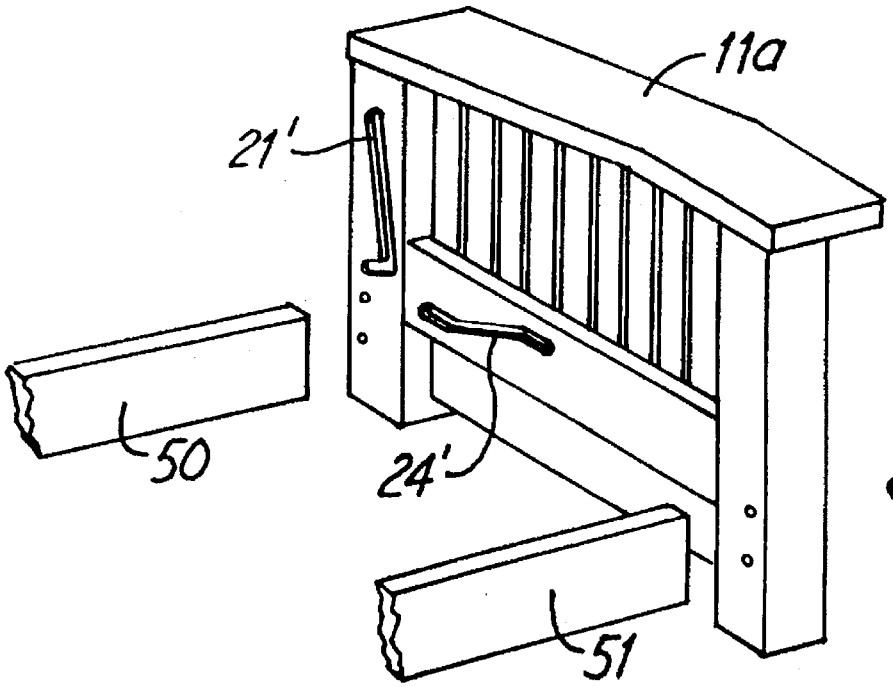
FIG. 11 shows a perspective view of one of the arms of the futon.

Referring to FIG. 1 reference numeral 10 identifies a futon frame having a first arm 11. Extending laterally outward from arm 11 is a first pad support member 12 and a second pad support member 13. FIG. 11 shows a second arm 11*a* with cross rails 50 and 51 that connects arm 11 to arm 11*a* to form a rectangular frame for supporting the pad support members. Arm 11 includes a first slot 21 shown in dashed lies for engaging a roller 22 attached to the side of pad support member 12 and a second slot 24 for engaging a second roller 25. Similarly, arm 11 on the opposite side (FIG. 11) includes slots 21' and 24' for supporting corresponding rollers on the opposite side of pad support member 12.

Figure 2:
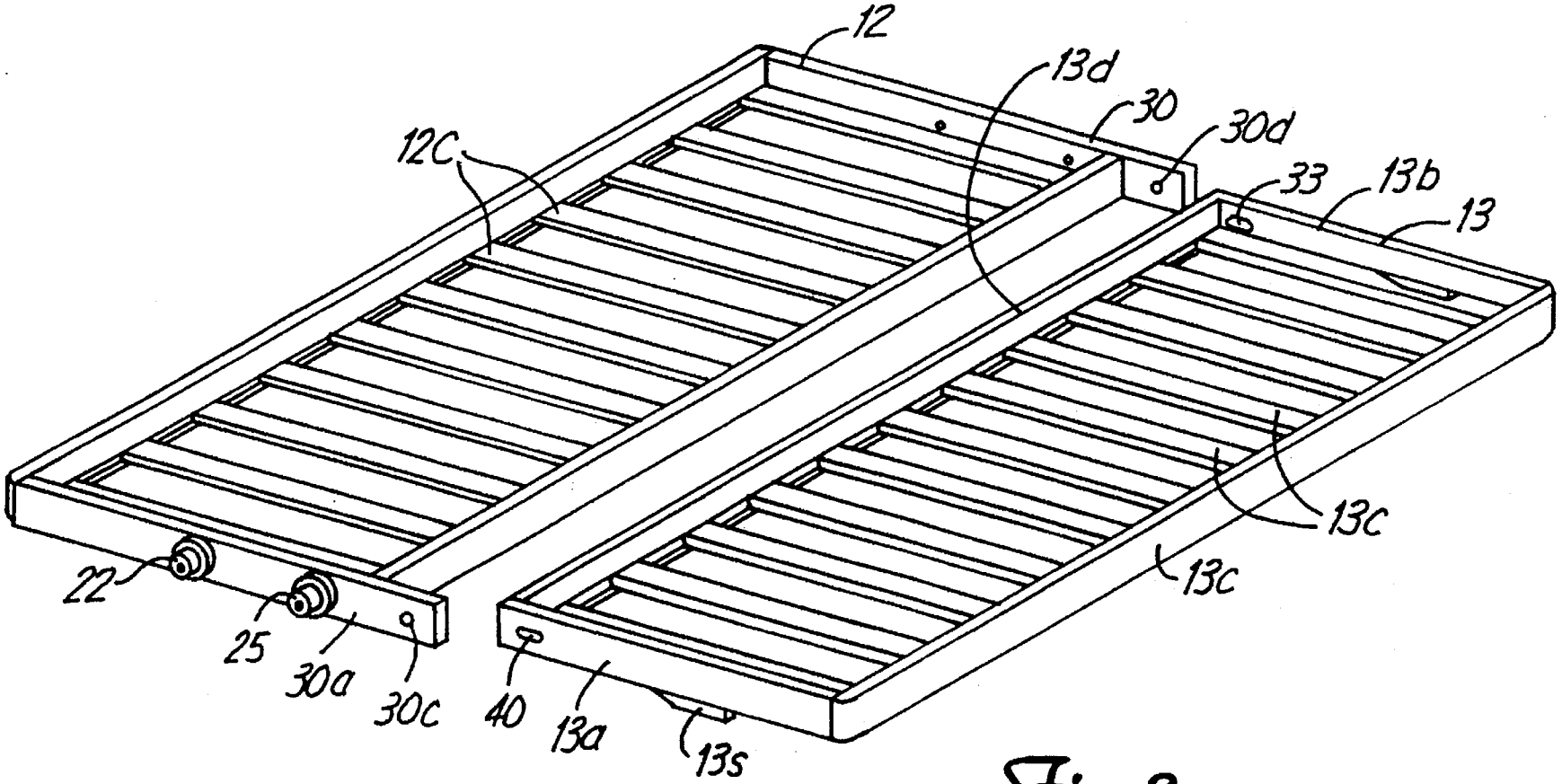
FIG. 2 shows a perspective view of the pad support members of the present invention in the unassembled position.

FIG. 2 shows the pad support members 12 and 13 in the unassembled position. In the embodiment shown, pad support member 12 could be the back rest frame member and pad support member 13 could be the seat frame member when the futon frame is converted into a couch. One end of pad support member 12 includes a first extension 30*a* with an opening 30*c* therein. Similarly, the opposite end of pad support member 12 includes a second extension 30 with an opening 30*d* therein. Pad support member 13 includes a front cross member 13*c*, a rear cross member 13*d* and two end members 13*a* and 13*b* and slats 14*c*. End member 13*a* includes an elongated opening 40 and similarly end member 13*b* includes an elongated opening 33. Pad support member 13 is sufficiently smaller in width than pad support member 12 to allow end members 13*a* and 13*b* to be held between first extension 30*a* and second extension 30 with free movement between the pad members with respect to each other. Located on the bottom of pad support member 13 is a first stop 13*s* and a second stop (not shown) which form engagment with cross rail 51.

Figure 3:
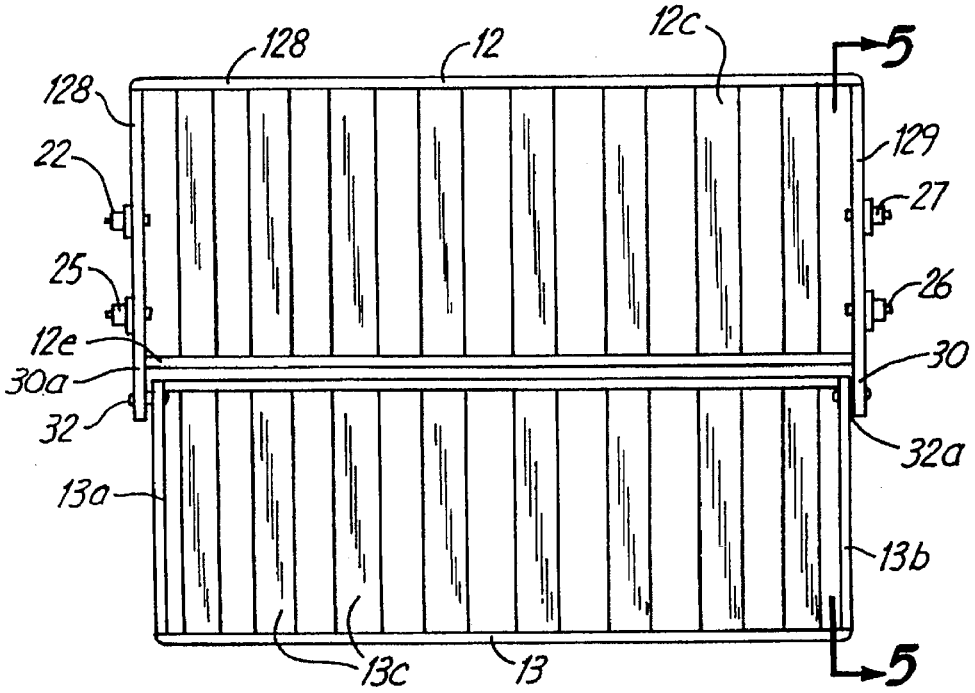
FIG. 3 shows a top view of the pad support members of the present invention in the bed position with the the pad support members located in pivotal engagement with each other.

FIG. 3 shows the pad support members 12 and 13 in the assembled position. In the assembled position a pin 32 connects extension 30*a* to end member 13*a* and similarly a pin 32*a* connects extension 30 to end member 13*b*. Pad support member 12 includes side members 12*d* and 12*g*, and cross members 12*f* and 12*e* and a set of slats 12*c*. Similarly pad support member 13 includes slats 13*c* for supporting a futon pad thereon. Located on one side of pad support member 12 are rollers 22 and 25 and located on the opposite side of pad support member 13 are rollers 26 and 27.

Figure 4:
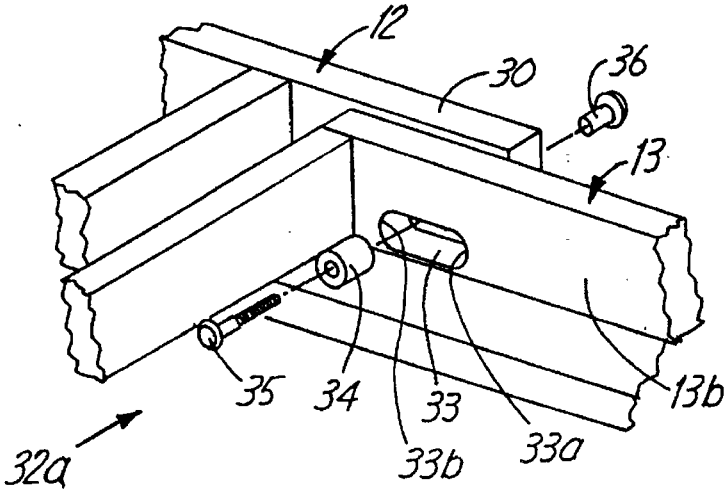
FIG. 4 shows a partial view of the pivotal members that connect the pad support members to each other.

FIG. 4 shows a partial sectional and exploded view of the pin 32*a* that connects extension 30 to member 13*b*. As pin 32 is identical, only pin 32*a* will be described. Pin 32*a* comprises a bolt 35, a nylon roller 34 that fits around bolt 35 and a cap nut 36 for securing to threads of bolt 35. In the assembled position roller 34 is positioned within a closed end 33*a* and a closed end 33*b* elongated guide slot 33 to permit lateral displacement of end member 13*b* with respect to extension 30. Similarly, pin 32 is position with respect to a first closed end and a second closed end elongated slot 40 to permit lateral displacement of end member 13*a* with respect to extension 30*a*.

Figure 5:
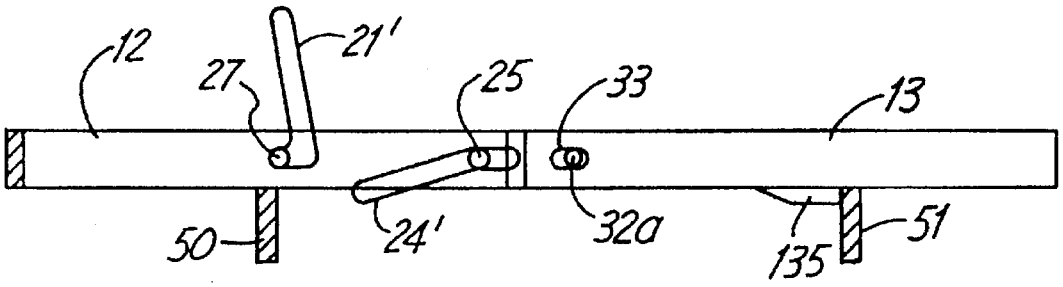
FIG. 5 shows a side of the futon pad support members in the bed position.

FIGS. 5 through 10 show a schematic of how the futon frame is converted from the bed position to the couch position. FIG. 5 is taken along lines 5—5 of FIG. 3 to illustrate the relationship of pad support members 12 and 13 during the repositioning of the couch. To illustrate how pad 12 moves with respect to the backrest guide slots in the end frame the slots in the end frame 11 are illustrated as 21' and 24'. The rollers 27 and 26 which are located on the right side of pad 12 are illustrated in their various positions in regard to the back rest guide slots 21' and 24' so that the action of converting the futon from a bed to a couch position can be illustrated.

FIG. 5 shows pad support member 12 and pad support member 13 in an abutting end to end relationship with each other. In this position pin 32*a* is located in the far right end of elongated slot 33. Pad support member 12 is supported by cross rail 50 and pad support member is supported by cross rail 51.

Figure 6:
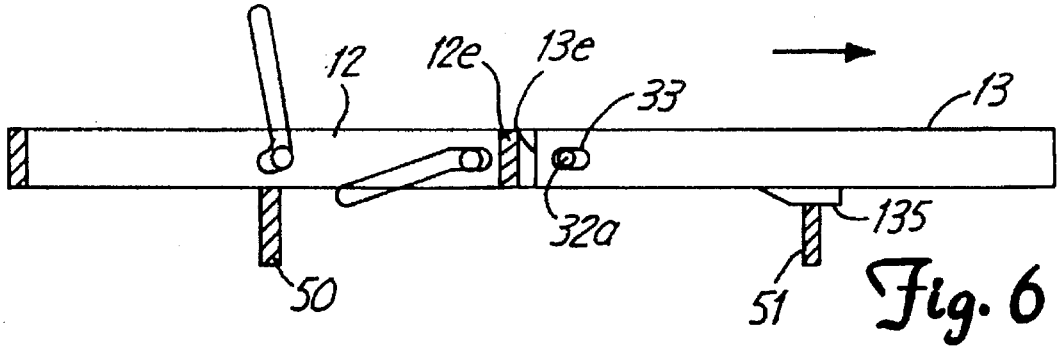
FIG. 6 shows the pad support members of FIG. 5 with the members extended from each other in an unlocked position to initiate the process of converting the bed into a couch.

FIG. 6 shows that pad support member 13 has been pulled longitudinally outward and away from pad support member 12. Note, end 13*e* is now spaced from member 12*e* with pin 32*a* now located in the left end of elongated slot 33.

Figure 7:
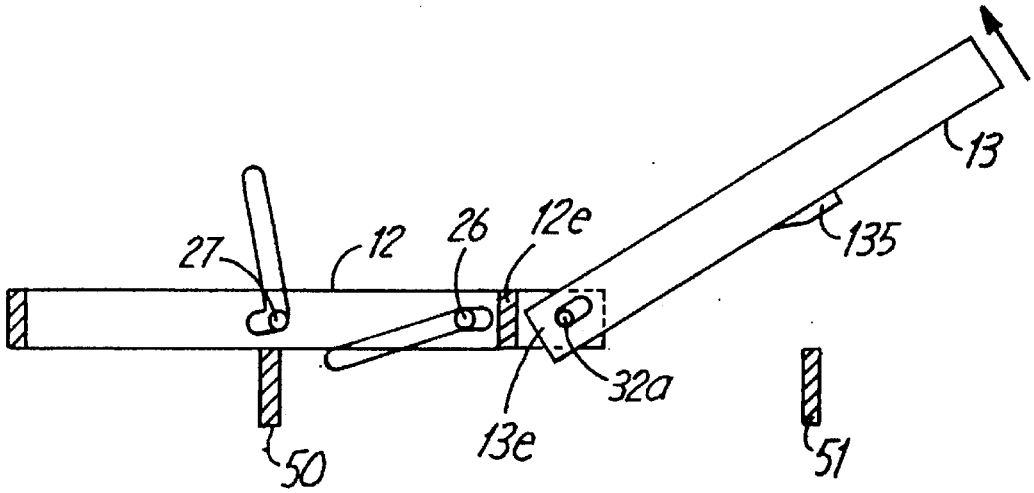
FIG. 7 shows the pad support members of FIG. 5 with one of the pad support members pivoted upward.

FIG. 7 shows that pad support member 13 being rotated counterclockwise about pin 32*a*. In this condition the end member 13*e* clears end member 12*e* to permit the upward rotation of pad support member 13.

Figure 8:
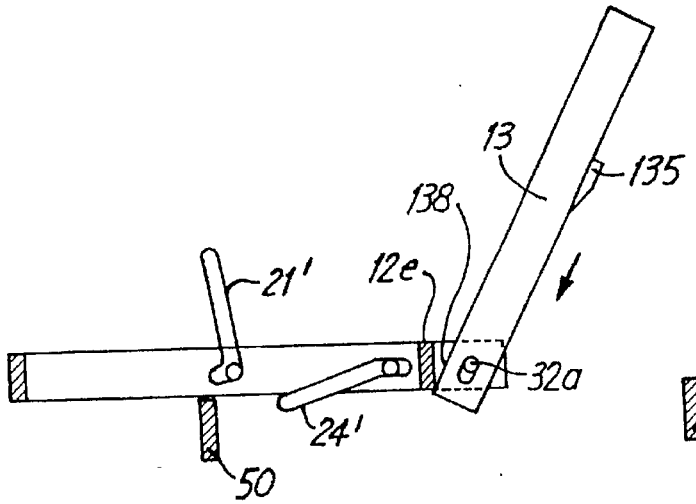
FIG. 8 shows the pad support members of FIG. 5 with one of the pad support members pivoted upward sufficiently far so as to form a lever type engagement with the other pad support member.

FIG. 8 shows that pad support member 13 has been rotated sufficiently so that the top edge 13*f* of pad support member 13 sits in engagement with member 12*e* of pad support member 12. Note the weight of pad support member 13 causes pad support member 13 to slide downward along pin 32*a* thus putting pin 32*a* at the top of elongated slot 33. In this condition, the two pad support members 12 and 13 are no longer in clearing relationship to each other but are in a temporary interlocking engagement with each other.

Figure 9:
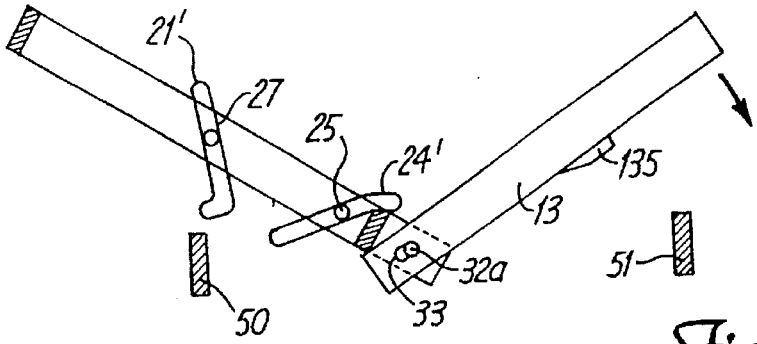
FIG. 9 shows the pad support members of FIG. 5 with one of the pad support members being used as a lever to move the other pad support member.

FIG. 9 shows pad support member 12 being rotated clockwise as pad support member 12 is temporarily used as a lever arm. Note that as the pad support member 12 is pivoted upward with the guide rollers 27 and 25 move along the slots 21' and 24' respectively. Thus the application of a lever like force to one end of pad support member 12 causes pad support member 12 to move from the horizontal position toward an upright position with the movement of the pad support member 12 being controlled by back rest guide slots 21' and 24'.

Figure 10:
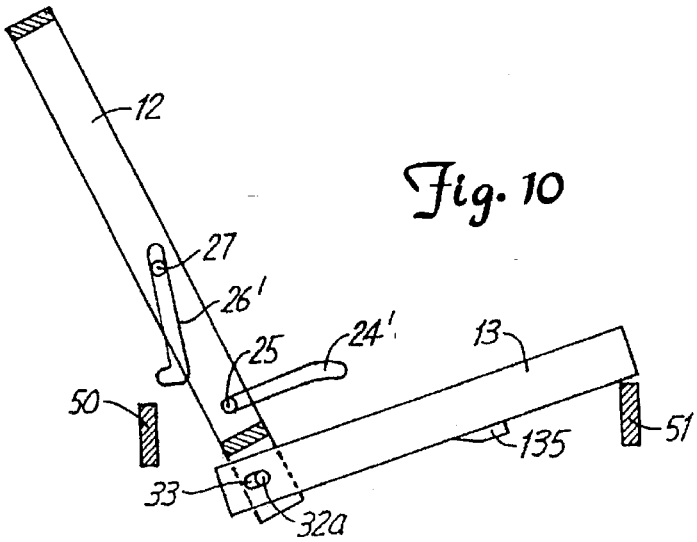
FIG. 10 shows the pad support members of FIG. 5 with one of the pad support members located in the back rest position and the other in the seat cushion position.

FIG. 10 shows that continued clockwise movement of pad support member 13 forces pad support member 12 to move to the backrest position and pad support member 13 to the seat position. Thus, from view of FIG. 5 to FIG. 10 it is apparent that all one has to do to move the futon frame from a bed position to a couch position is to pull out pad support member 13, rotate it upward until the pad support member 13 interlocks with pad support member 12, push down on pad support member 13 to raise the pad support member 12 and bring the unit into the couch position, wherein pad support member 12 acts as a back rest and pad support member 13 acts as a seat.

If one wants to covert the unit from the couch position to the bed position the user lifts up on pad support member 13 and pulls on pad support member 13 causing pad support member 12 to move with respect to back rest guide slots 21' and 24'. That is, a pulling force on pad support member 12 pulls pad support members 12 and 13 free of interlocking relationship to permit the pad support member 13 to move to the horizontal position shown in FIG. 5.

We claim:

1. A futon for converting from a couch position to a bed position and back again comprising:

a frame, said frame having guide slots therein;

a first pad support member, said first pad support member including projections for engaging said guide slots to permit displacement of said first pad support member with respect to said frame;

a first extension and a second extension secured to said first pad support member;

a cross member extending between said first extension and said second extension;

a second pad support member having a first end with an elongated opening therein having a first closed end and a second closed end and a second end with an elongated opening therein having a first closed end and a second closed end;

a first pivotal member pivotally connecting said first extension to said first end of said second pad support member with said first pivotal member slideable toward the first closed end in the elongated opening in said first end of said second pad support member;

a second pivotal member pivotally connecting said second extension to said second end of said second pad support member with said second pivotal member slideable toward the first closed end in the elongated opening in said second end of sad second pad support member, said first end of said second pad support member and said second end of said second pad support member spaced sufficiently far from said cross member when said pivotal members are in said first closed end of said elongated openings so that said first end of said second pad support member and said second end of said second pad support member can be rotated with respect to said cross member without engagement with said cross member and said first end of said second pad support member and said second end of said second pad support member spaced sufficiently close to said cross member when said pivotal members are in said second closed end of said elongated openings so that said second pad support member can engage with said cross member of said first pad support member to enable said second pad support member to be temporarily used as a lever arm to move said first pad support member to a couch position where the only mechanical connection between said first pad support member and said second pad support member occurs at said pivotal members.

2. The futon of claim 1 wherein the pivotal members include rollers for displacement within the respective elongated openings.

3. The futon of claim 2 wherein the first extension and said second extension cooperate with said pivotal members to hold said second pad support member in a displaceable and pivotal relationship to said first pad support member.

4. The futon of claim 3 wherein the first pad support member and said second pad support member includes slats for supporting a portion of a pad thereon.

5. The futon of claim 4 wherein the first pad support member and said second pad support members are made of wood.

6. The futon of claim 5 wherein the projections on said first pad support members include rollers for slidingly engaging said guide slots.

7. The futon of claim 6 wherein the frame includes arm rests secured thereto.

8. The futon of claim 7 including cross rails for engaging said arm rests to form a box like frame for said pad support members.

9. The futon of claim 6 wherein the elongated slots have sufficient length so that when the pivotal member in one end of the elongated opening in the pad support member cannot be rotated without longitudinally displacing pad member.

10. The futon of claim 9 wherein the frame is made of wood and the pad support members are made of wood.

11. A futon for tilting from a bed position to a couch position and vice versa comprising:

a frame; and a first pad support member having a pivot member and a second pad support member, said second pad support member having a closed opening for receiving and retaining said pivot member, said second pad support member laterally and pivotally displaceable with respect to said first pad support member with said second pad support member spaced sufficiently far from said first pad support member when said pivot member is in a first position in said closed opening so that said second pad support member can be rotated with respect to said first pad support member without engagement with said first pad support member and said second pad support member spaced sufficiently close to said first pad support member when said pivot member is in a second position in closed openings so that said second pad support member can engage said first pad support member and said pivot member to form a pivotable lever arm for engaging said first pad support member to enable the second pad support member to used as a lever to raise the first pad support member from a horizontal position to a generally vertical position to thereby convert the futon from a bed position to a couch position where the only mechanical connection between said first pad support member and said second pad support member occurs where said first pad support member pivots with respect to said second pad support member.

* * * * *